United States Patent [19]

Torn

[11] 3,985,957

[45] Oct. 12, 1976

[54] SOUND MASKING SYSTEM FOR OPEN PLAN OFFICE

[75] Inventor: William R. Torn, St. Charles, Ill.

[73] Assignee: DuKane Corporation, St. Charles, Ill.

[22] Filed: Oct. 28, 1975

[21] Appl. No.: 626,240

[52] U.S. Cl. ..... 179/1.5 M; 179/1 GA; 179/1 E; 179/1.5 R; 181/154

[51] Int. Cl.[2] ..... H04K 1/00

[58] Field of Search ..... 179/1.5 M, 1.5 R, 1 GA, 179/1 E; 181/198, 154; 340/15

[56] References Cited

UNITED STATES PATENTS

| | | | |
|---|---|---|---|
| 3,541,258 | 11/1970 | Doyle et al. | 179/1.5 M |
| 3,879,578 | 4/1975 | Wildi | 179/1.5 M |

*Primary Examiner*—Howard A. Birmiel
*Attorney, Agent, or Firm*—Robert L. Kahn

[57] ABSTRACT

This invention relates to a system for masking conversation in an open plan office. A conventional generator of electrical random noise currents feeds its output through adjustable electric filter means to speaker clusters in a plenum above the office space. Each cluster has two speakers in a trigonal prism-shaped cabinet, symmetrically disposed about an axis of symmetry, oriented to be vertical. The speaker arrangement is such that, throughout the open plan office area, including below speaker clusters, the background sound energy level horizontally in the open plan office space has a generally constant value except for a modification which provides for a quiet region below a cluster. By proper spacing of clusters horizontally along the plenum region, transmission of background masking sound through an acoustic ceiling throughout an open plan office space, conversation in one region of the office cannot be distinguished at a distance of the order of about 15 feet or more.

3 Claims, 3 Drawing Figures

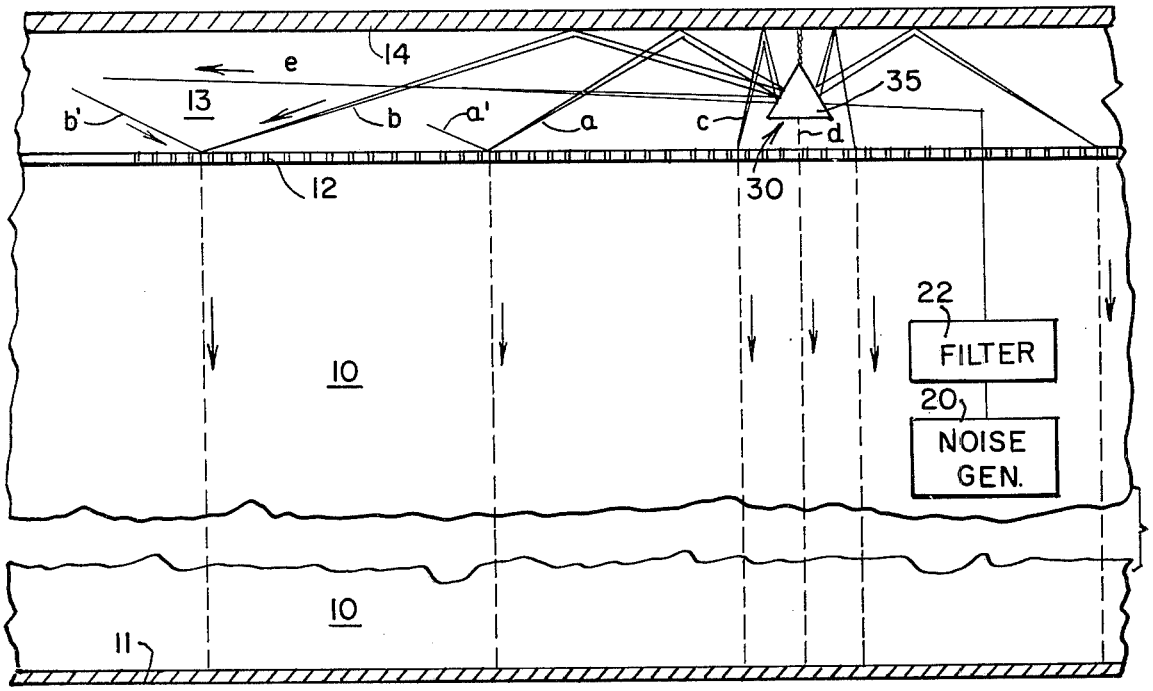
FIG. 1
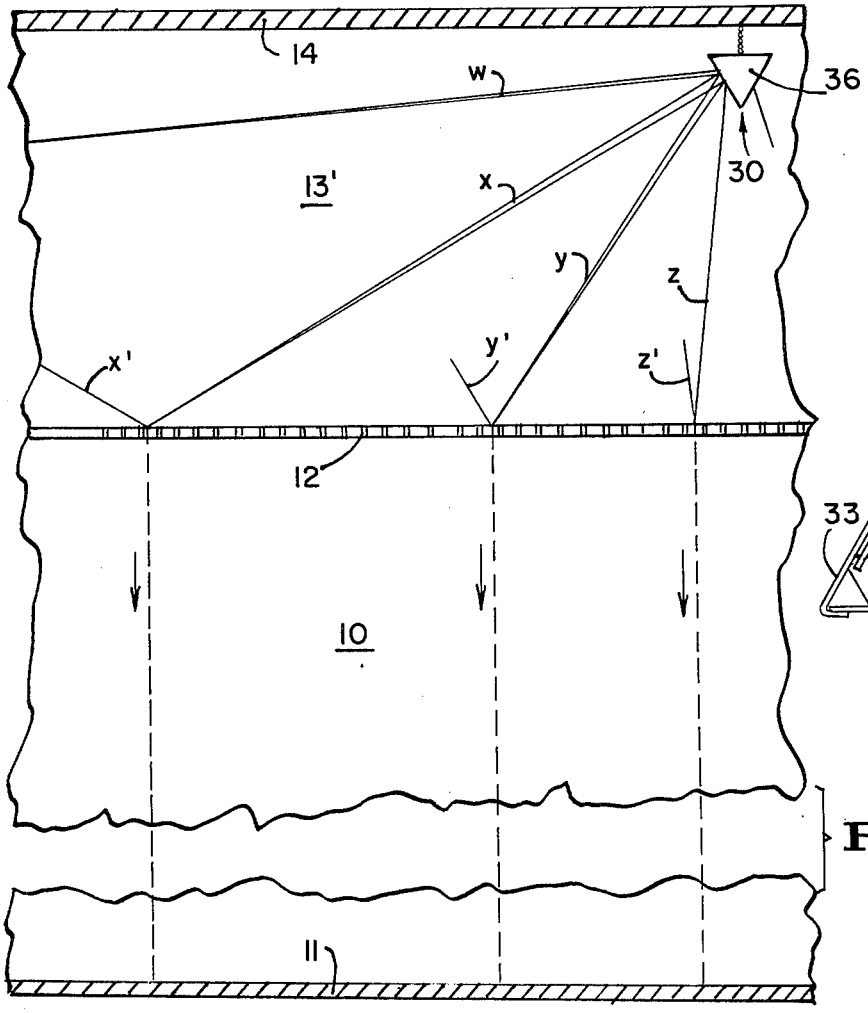
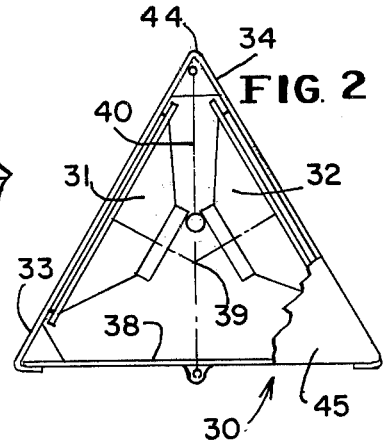
FIG. 2
FIG. 3

SOUND MASKING SYSTEM FOR OPEN PLAN OFFICE

This invention relates to a system for electronically generating an all-pervasive, unobjectionable low background random noise or acoustic "haze" in an open plan office area free of any walls, to acoustically "partition" any office sub-area from other office sub-areas to obtain conversational privacy. This acoustic "haze" is dispersed throughout the masked space to be reasonably free of being detected by typical room occupants. Even acoustic experts should find it difficult to pinpoint emanating sources. The new system effectively improves on the results obtainable with extraneous "acoustic" props, such as movable partitions or screens, to absorb or reflect sound for local alteration of acoustic characteristics. The new system fundamentally operates directly on the acoustic characteristics of the open plan office region defined by acoustic ceiling, floor, side walls, posts, lighting fixtures, air vents, etc. The new system is adapted to operate upon the acoustic space within the open plan office to substantially decrease the threshold of the otherwise normal intelligibility range from any sub-area office location to an adjacent office location. As a result of such change of intelligibility threshold, no specific locations of any sub-areas are required where a particular office group may be located. This is in contrast to prior systems requiring well-spaced locations or elaborate acoustic barrier systems for office sub-areas for a conference group to insure conversational privacy.

It has been found that acoustically treated ceilings of so-called soundproof materials alone in open plan offices are not effective to prevent a conversation from being understood at regions spaced from the sub-area where a conversation is taking place. It is true that such a sound-deadened ceiling does reduce the level of noise and in all systems for obtaining speech privacy an amount of soundproofing in the ceiling is an essential component of the entire system. However, so-called soundproof ceilings in reality do not completely absorb speech frequency sound energy. Instead, such ceilings do reflect and also transmit therethrough speech frequency sound energy to a degree where complete reliance upon such ceilings alone is not possible. Much investigative effort has been expended in the study and development of acoustic ceiling materials having suitable absorptive, reflective and transmissive properties commensurate with cost.

Attempts have been made to provide electronically generated sound means and procedures for masking speech emanating from a particular sub-area of an open plan office against overhearing intelligibility by others. Among expedints relied upon are loud speakers located in plenum regions above an acoustic ceiling. Such plenum regions usually have a ceiling or deck just below the next higher building floor above the open plan office. As a rule, a number of individual speakers are disposed in the plenum space above the acoustic office ceiling and emit "masking" sounds continuously. Frequently, individually adjustable filters covering overlapping audio frequency bands of about ⅓ octave ranging from about 250 HZ. to about 5000 HZ. are connected between the masking noise generator and speakers for matching to office acoustic properties. The objective is to have such masking sounds strike the rear or plenum side of the acoustic ceiling and pass through the same into the open plan office space to provide background noise, for masking conversation throughout the open plan office.

A serious drawback to prior systems has been the outstanding unevenness of the masking sound energy level throughout the open plan office space. In particular, the variation of background masking noise level below the office acoustic ceiling was such that as one moved along the office, significant variations in masking sound levels would be heard, a peak in sound energy level generally being noted just below a speaker and dip between speakers. As a result of this lack of uniformity of the level of masking sound energy, different office sub-area locations would be subject to substantially different sound masking effects. In such prior systems it had been necessary to definitely locate sub-areas where some conversational privacy might be attained. However, the overall uneven characteristicss of such systems are irritating, unsatisfactory, and undependable.

THE INVENTION GENERALLY

The present invention herein disclosed cures the above defects in prior systems by providing clusters of two speakers at intervals throughout the plenum region above the open plan office acoustic ceiling. A speaker cluster comprises two loud speakers in a trigonal prism cabinet, the speakers, when operating, being symmetrical about a cluster axis generally vertical and radiating sound away therefrom at equal angles to the cluster axis. It is understood that the speakers in a cluster are generally matched for best results and are equally energized. The speaker clusters are fed by electric currents corresponding to the "random noise" sound energy.

A cluster of speakers embodying the present invention may have the speakers connected either in series or in parallel and may have the two speakers in a cluster connected in acoustic aiding or opposing relationship, depending upon dimensional characteristics of the plenum region.

A speaker may be of the permanent magnet dynamic type, having a generally conical diaphragm. A cluster of two speakers is disposed within a common cabinet, said cabinet being of metal, wood, or synthetic materials, such as pressed wood, or plastic and may have simple sound reflecting walls within the cabinet or may have some sound absorbing material therein for loading each speaker. The speaker cabinet has a trigonal prism shape, the section generally showing an isosceles triangle and more specifically an equilateral triangle. The two speakers making up a cluster have their respective axes (a speaker axis is presumed to be the axis of the speaker diaphragm) disposed at equal angles, extending above or below a horizontal plane within the plenum region and both intersecting the cluster axis at one point. The angle of inclination of aa speaker axis with respect to a horizontal plane should be in the order of about 30°, although larger or smaller values within substantial limits will work.

Thus, for example, for a plenum having a high plenum ceiling (of the order of about 9 feet), a cluster may be mounted high in the plenum so that the speaker axes incline downwardly, toward the ceiling of the open plan office area (away from the plenum ceiling), then the axis of cluster symmetry will also extend downwardly from the cluster toward the acoustic ceiling of the open plan office area. Fundamentally, the operation of the invention is dependent upon the fact that an acoustic ceiling for an open plan office does transmit, absorb and reflect sound energy and that the plenum ceiling reflects sound, although some absorption takes place.

A cluster of speakers may also be mounted (inverted) so that the axes of the speakers of a cluster extend upwardly toward the plenum space ceiling, with the axis of symmetry still vertical. Assuming the plenum ceiling reflects sound, a necessary condition, the net effect of speakers in a cluster cabinet will be to provide a region of reduced sound intensity below the cluster extending through the acoustic ceiling of the open plan office area toward the office floor. This reduced sound energy level below the speakers equalizes the masking sound level going straight down from the cabinet with sound levels reflected from the plenum ceiling passing through to the office space away from below the cluster. It is understood that the entire system from random noise generators through filters and speakers will be adjusted to a desired level of unobtrusive background sound energy in the open plan office space.

The energy level in the open plan office space should be low enough so that the noise constitutes a background which is not obtrusive but yet is at a sufficiently high level so as to provide acceptable isolation from undesired conversations. The energy level of the background noise frequencies throughout the open plan office will be such as to keep the sound transmission medium, in this case the air, in a sufficiently agitated state so that a remote listener (not supposed to overhear) is effectively prevented from eavesdropping, whether willingly or not. Overhearing unwanted conversation at any region in the open plan office space utilizing the present invention will be minimized to the point where substantially complete masking is provided. In effect, sound transmission of speech frequencies through air subjected to such acoustic turmoil, is effectively impeded between sub-areas. It is understood that the masking sound energy levels in the plenum space will be relatively higher to compensate for sound losses. A cluster may be provided with a volume control to adjust noise current sound levels when necessary for compensating purposes.

DESCRIPTION OF THE DRAWINGS

Referring to the drawings,

FIG. 1 is an elevation of an open plan office space and a relatively shallow plenum space above it having a masking system embodying the present invention installed for operating on a space within the open plan office, the lines of force suggesting idealized sound travel paths, the lines emanating from the speakers being heavy, to indicate high sound intensity and tapering to indicate fall off, inversely as the square of distance, no attempt being made to carry this indication to its ultimate conclusion, or to show quantitiatively the amount of energy loss in absorption or reflection.

FIG. 2 is a detail, on an enlarged scale, of a loudspeaker cluster showing the cluster cabinet and orientation of speakers therein.

FIG. 3 is a diagrammatic view of a speaker cluster mounted in an inverted position from that illustrated in FIG. 1, for use in a deep plenum, having a high plenum ceiling above the acoustic ceiling of the open plan office, the showing of sound intensity generally following that of FIG. 1.

DESCRIPTION OF THE PREFERRED SPECIES

Referring to FIGS. 1 and 2, an open plan office space 10 is illustrated, having floor 11, acoustic ceiling 12 and walls (not shown). Above acoustic ceiling 12 is plenum region 13 having as its ceiling deck 14 of any suitable material. Deck 14 is of material to provide for substantial sound reflection of noise originating in a speaker cluster suitably mounted within the plenum region and hitting the deck or plenum ceiling. The plenum deck or ceiling may be of sheet metal, plywood, or synthetic sheet material, all of which will provide sufficient sound reflection for aiding the operation of the system embodying the present invention.

It is understood that a system embodying the present invention must be adjusted to suit the sound reflecting characteristics in the plenum space, as well as the sound transmitting characteristics of the acoustic ceiling of the open plan office area. Insofar as building structure is concerned, no attempt is made to show beams or joists or girders or ducts forming part of the building construction. Such construction is conventonal. Similarly, no attempt is made to show the full contents of the plenum space or region, in which there may be disposed ducts for heating, air conditioning, electrical conduits, and other plumbing and electrical accessories. The plenum space may vary in height depending upon the particular building involved, and may range from about 2 or 2½ feet up to as much as 9 feet. It is understood that the height of the plenum region will be a factor in the operation of a masking system embodying the present invention and may determine whether a speaker cluster will be disposed as in FIG. 1 or in FIG. 3. Suitable adjustment of the masking sound energy level must be made to accommodate the sound propagating properties of the plenum region.

A source or generator of "random noise" electric currents or potentials 20 is provided. The random noise generator may be any one of a number of such generators available on the market and may provide electric noise potentials of desired magnitudes, depending upon the volume of space in the plenum and open plan office for masking, the number and spacing of speaker clusters, the characteristics of the acoustic ceiling, and other known factors. The random noise generator 20 is energized from a suitable source of power, usually a 115 or 230 volt A.C. power line. Noise generator 20 may be disposed in a suitable cabinet which may be positioned in any part of the open plan office or in closets or regions outside of such open plan office area, and is normally available for service and/or adjustment of energy levels to be used in the operation of the system. The output of noise generator 20 is fed to an adjustable electric filter system 22 which includes a combination of separate band-pass filters, the adjacent filter bands preferably overlapping as hereinbefore explained. Each band-pass filter is provided with means for controlling or adjusting the peak envelope of the energy level of the particular filter output. Such filter systems are also readily available on the market in connection with masking systems. As a rule, such systems operate on speech frequencies ranging from about 250 cycles per second to about 5000 cycles per second, although a narrower or broader range may be provided, depending upon special circumstances.

The noise currents at the output of the filter system are fed to speaker clusters. The two speakers in a cluster may be connected in series or in parallel and clusters may also be connected in series or in parallel. In general, it is preferred to have the speakers in each cluster connected similarly as, for example, all in series within the cluster, or all in parallel within the cluster. Insofar as the connections between speaker clusters are concerned, it may be desirable to connect various clusters of speakers in parallel to each other to avoid undesirably high potentials for energizing the clusters. However, various connections and transformers for energizing the speaker system may be provided.

The output of the noise generator and filter units is fed to speaker clusters supported within the plenum region. Referring, for example, to FIG. 2, a speaker cluster 30 consists in its simplest form of two loud speakers 31 and 32, mounted in flat boards 33 and 34, in a manner generally resembling the mounting of a speaker in a conventional radio receiver speaker cabinet. Speaker supporting panels 33 and 34 may be of wood, metal or any other suitable material in which a speaker may be supported. While the speaker diameter of the cone may vary within wide limits, it has been found that an 8 inch speaker whose large cone end measures substantially 8 inches across in diameter, is satisfactory. Speakers 31 and 32 are similar and can be ordinary speakers as in public address systems without extended frequency response, as is generally true in the case of quality speakers for radios, phonographs or in T.V. receivers.

A speaker should be sufficiently rugged to operate at desired levels of power. Thus, an 8 inch permanent magnet speaker of the dynamic type used in conventional public address systems and capable of an audio frequency output of about 5 watts can be used. The greater the speaker power, the greater the spacing may be between speaker clusters. However, it is not desirable to have too much power per speaker since maintenance of a generally uniform level of audio power within the office space might be rendered difficult. While speakers having a larger or smaller cone diameter than 8 inches may be used, it is preferred to have 8 inch speakers so that spacing between adjacent clusters need not be in excess of between about 10 and about 20 feet in horizontal directions. Too large a speaker, as 12 or 15, results in excessive noise level below a cluster. Too small a speaker, as 5 inches, requires too many clusters, closely spaced, to be economical. Thus, a new complete masking system having a number of speaker clusters need not require a large number of speaker clusters and will ordinarily provide a generally uniform masking effect throughout the space within the open plan office.

The filter means may be eliminated by providing speaker means having special frequency response characteristics to compensate for absence of filters.

Speaker support panels 33 and 34 are part of a cabinet having ends 35 and 36, said cabinet having a trigonal prism shape having an equilateral triangular cross section. The prism sides or panels 33 and 34 and an additional connecting panel 38 have a cross section in the shape of an equilateral triangle, with the speaker supporting panels 33 and 34 having equal widths. Connecting panel 38 preferably has the same width as the speaker panels to provide 60° angles between cabinet prism sides. The 60° angles for the prism sides are desirable for sound radiation to produce desirable sound coverage and reflection angles. From the geometry of the cabinet and speaker disposition, one speaker axis will be inclined to the speaker axis of the remaining speaker when both are mounted in a cabinet. It is understood that a speaker will be mounted in its own baffle board panel in the same general manner as a speaker is mounted in a baffle board panel for use in a conventional speaker cabinet. With such a mounting, the axes of symmetrically mounted speakers making up a speaker cluster, when mounted in a plenum, will intersect at a point 39. Point 39 will be on a vertical axis 40 extending through ridge 44 of the cabinet along the bisector of the equilateral triangle section.

By positioning the two speaker cluster as illustrated in FIG. 1, cabinet ridge 44 will be horizontal and at the top of the cluster cabinet. The cluster cabinet may be provided with suitable apertures in the cabinet walls for affecting changes in frequency response. This practice is well known in the loud speaker art. The speaker cones will be aimed upwards toward the ceiling of the plenum region. The speaker angle of inclination may differ from 60° in special cases by control of the width of the odd panel not carrying a speaker. It is also possible to mount a speaker so that its axis is not perpendicular to the baffle board plane. It is essential to have the speaker axes symmetrical to the cluster axis. Thus, audio output from both speakers will tend to diverge from the cluster axis extending below the cluster, minimizing the effect of it being a fixed sound source.

The cluster disposition illustrated in FIG. 1 provides for reduced sound energy level radiation below a cluster to the open plan office space and higher levels of sound energy through longer paths in the open plan office space away from below a cluster. Thus, sound energy level uniformity is attained in the open plan office region.

Referring to FIG. 3, it is possible to invert a cluster so that the speakers beam their output downwardly. In such case, sound reflections from the plenum ceiling will pass to and through the acoustic celing into the office space.

In further reference to FIG. 3, by feeding two speakers of a cluster in bucking or opposed phase relation, a generally cone-shaped region of freedom from background noise below such cluster can be provided. Such a preselected conversational sub-area in an open plan office will be masked but is fixed below such cluster.

The cluster suspension of FIG. 3 can be used where a plenum region has a high ceiling such as about 9 feet. By having cluster speakers beam their random noise downwardly, a suitable level of random noise can be maintained in the open plan office space. It is understood that the elevation of clusters in the plenum can be adjusted to provide desired sound levels.

In all cases, a longitudinal prism axis is defined by the intersection of the three perpendicular bisectors of the prism sections. The cabinet suspension axis will be perpendicular to the prism axis and ordinarily will intersect the prism axis midway between the prism ends, closed by triangular end plates 45.

A precise technical analysis of sound reflection, absorption, and transmission through solid and gaseous materials is an extremely complicated procedure considering the multitude of variables encountered in ceiling constructions. Furthermore, classic theories relating to standing acoustic waves relying on cyclic generation of sound are not applicable here where the sound is of a random, noncyclic nature. However, in generalized simplicity, one might visualize the operation of this invention as follows.

In FIG. 1, assume a random pulse (pressure region) being generated by the loudspeaker momentarily. This wavefront will emanate from the trigonal housing in all directions. In certain directions energy content will be different than in others. For example, in a direction depicted by ray *a* on a loudspeaker axis, maximum energy will emanate. As this energy travels through the air, it will diminish about inversely as the square of distance traveled (shown diagrammatically as becoming thinner). Energy will be lost as ray *a* bounces off the deck and as it travels toward the acoustic ceiling (by now shown as a thin line). Again more energy is absorbed, some reflected, but a useful amount is transmitted through and into the open plan office (dotted lines).

Consider ray *b*, somewhat off the loudspeaker axis. It has a lower energy level (narrower line) and as its course is followed, it becomes weaker than desired by the time it strikes the acoustic ceiling. A ray *b* is shown as a reinforcement coming from an adjacent speaker cluster (not shown) properly placed for this to occur. The energy transmitted through the acoustic ceiling is now the resultant of the two rays and is about equal to what was delivered by ray *a*.

As for ray *c*, being considerably off axis (thin line), it has less energy content than *a* or *b*, but it traverses a shorter distance, still reaching the point of penetration into the open plan office area with essentially comparable level as rays *a* and *b*.

Ray *d* is the resultant of energy created by the action of both loudspeakers driving the housing. It is the weakest ray so far named but travels the shortest distance and loses minimum energy, again penetrating at a desired level of amplitude.

Another ray *e* is shown. It depicts the reverbrant energy which may bound off ducts, pipes, walls, etc. This energy, too, finds its way through the acoustic ceiling, and by suitable placement of speaker clusters, advantage may be taken of this. There are an infinite number of rays to be considered, but the above is a simplified discussion of the essentials. Clusters must be placed to obtain as uniform a distribution of random noise through the acoustic ceiling as is practical.

In FIG. 3, if the distance between the deck and acoustic ceiling becomes rather great (8 or 9 feet), because of the oblique angles involved in ray paths of FIG. 1, noticeable levels of acoustic "haze" might be encountered in the open office, particularly quiet spots directly under a cluster. To enhance the noise masking effect in this case, the speaker cluster is inverted as shown. As illustrated before, the on-axis ray *x* is the maximum energy ray, but travels further than weaker ray *y* or weakest ray *z* — all three reacting with such force and angle to penetrate the acoustic ceiling equally. Ray *w* is a reverbrant ray and may or may not contribute to the net masking noise depending on what it strikes in the plenum region. Note that this arrangement has little dependence on reflections from the deck, and while some bounce occurs from the deck, for simplicity again, only selected rays are shown, it being understood that an infinite number of paths emanate from the cluster as previously stated.

The illustration of FIG. 3 shows the cluster as being mounted high up toward the deck. In actual practice of the invention, there is some latitude as to selected heights, but in the final end, listening tests or acoustic noise measurement shuold be made to verify best placement for desired uniform dispersion of masking noise.

In both FIGS. 1 and 3, the region between floor and ceiling of the open plan office is shown as broken to conserve space in the drawing. The actual distances in practice are not necessarily dependent upon plenum height and will depend upon building construction considerations.

While speakers having conventional cones (with circular sections) are shown, it is possible to use elliptical cones. For an 8 inch cone speaker, the triangular prism-shaped cabinet may have panels for the speakers which may be about 13 inches wide and about 19 inches long. However, larger or smaller cabinets may be used, depending upon speaker clearances within the cabinet, desired acoustic characteristics, speaker sizes, etc.

What is claimed is:

1. An acoustic masking system for obtaining conversational privacy in an open plan office space having a floor and an acoustic ceiling wiith a plenum space above said ceiling, said plenum space having its own sound reflecting ceiling, said office acoustic ceiling having characteristics incuding sound absorption, reflection and transmission therethrough, said system having a generator for providing electric currents which are reproduced by a loud speaker as predetermined random noise, and speaker means connected to be energized by said generator output, said speaker means consisting of at least one cluster of two speakers for mounting in said plenum region, a cluster having a trigonal prism-shaped speaker cabinet having three flat prism panels shaped and assembled to form a triangular prism-shaped hollow cabinet with two triangular end plates, a loud speaker mounted in two of said prism side panels, each panel functioning as a baffle board for propagating sound outwardly by its speaker, said cabinet being adapted to be installed in the plenum region to orient said prism horizontally, said speakers being symmetrically disposed in their panels when said cluster is installed and being equally inclined from a horizontal plane in such installed position, said speakers being similar and adapted to be simlarly energized so that sound waves from said speakers can travel along air paths to solid surfaces for reflection therefrom, absorption thereby, and transmission therethrough to provide masking background noise in the open plan office.

2. The system according to claim 1, wherein said speakers are of the 8 inch permanent magnet dynamic type.

3. The system according to claim 1, wherein filter means are connected between the generator and speaker means.

* * * * *